US008110733B2

(12) United States Patent
D'Arco

(10) Patent No.: US 8,110,733 B2
(45) Date of Patent: Feb. 7, 2012

(54) TUNING STABILIZER FOR STRINGED INSTRUMENT

(76) Inventor: Daniel D'Arco, Pottsville, PA (US)

( * ) Notice: Subject to any disclaimer, the term of this patent is extended or adjusted under 35 U.S.C. 154(b) by 0 days.

(21) Appl. No.: 12/917,056

(22) Filed: Nov. 1, 2010

(65) Prior Publication Data

US 2011/0094366 A1 Apr. 28, 2011

Related U.S. Application Data

(62) Division of application No. 12/250,672, filed on Oct. 14, 2008, now Pat. No. 7,858,865.

(51) Int. Cl.
*G10G 7/02* (2006.01)

(52) U.S. Cl. ..... 84/454; 84/455; 84/457; 84/312 R; 84/313; 84/314 N; 84/304

(58) Field of Classification Search ..... 84/454–457, 84/312 R, 313, 314 N, 304
See application file for complete search history.

(56) References Cited

U.S. PATENT DOCUMENTS 2,955,503 A * 10/1960 Braverman ..... 84/306
3,691,894 A 9/1972 Schneider et al.
4,378,723 A 4/1983 Scholz
4,453,443 A 6/1984 Smith
4,475,432 A 10/1984 Stroh
4,567,808 A * 2/1986 Smith ..... 84/422.1
4,625,614 A * 12/1986 Spercel ..... 84/306
4,655,116 A 4/1987 Matsui
4,690,027 A 9/1987 Ido
4,878,413 A 11/1989 Steinberger
4,909,126 A 3/1990 Skinn et al.
5,009,142 A * 4/1991 Kurtz ..... 84/454
5,038,657 A * 8/1991 Busley ..... 84/455
5,065,660 A 11/1991 de Buda
5,095,797 A * 3/1992 Zacaroli ..... 84/455
5,097,736 A 3/1992 Turner
5,097,737 A 3/1992 Uhrig
5,171,927 A 12/1992 Kubicki et al.
5,198,601 A 3/1993 McCabe
5,265,512 A 11/1993 Kubicki et al.
5,323,680 A * 6/1994 Miller et al. ..... 84/455
5,343,793 A 9/1994 Pattie
5,390,579 A * 2/1995 Burgon ..... 84/454
5,392,680 A * 2/1995 Stets ..... 84/313
5,438,902 A 8/1995 Baker
5,637,820 A 6/1997 Wittman
5,750,910 A 5/1998 LoJacono
5,756,913 A 5/1998 Gilmore
5,886,270 A 3/1999 Wynn
5,977,467 A * 11/1999 Freeland et al. ..... 84/454
D421,621 S * 3/2000 Cooper ..... D17/99
6,166,307 A 12/2000 Caulkins
6,175,066 B1 1/2001 McCabe
(Continued)

*Primary Examiner* — Elvin G Enad
*Assistant Examiner* — Robert W Horn
(74) *Attorney, Agent, or Firm* — Fox Rothschild LLP; Dennis M. Carleton

(57) ABSTRACT

A self-contained tuning stabilizer for a stringed instrument consists of a body which is attachable to the stringed instrument like a capo, the stabilizer containing mechanical members for increasing or decreasing the tension on each of the strings to keep them in tune as the instrument is played. The device contains sensors for each string, an analyzer for determining if the frequency produced by each string is correct, and a driver for each of the mechanical members for applying micro-tuning corrections to the strings. The device must first be zeroed, and the instrument tuned by hand. Thereafter, the device will maintain the original tuning.

17 Claims, 5 Drawing Sheets

U.S. PATENT DOCUMENTS

| | | | | |
|---|---|---|---|---|
| 6,184,452 | B1 | 2/2001 | Long et al. | |
| 6,278,047 | B1 | 8/2001 | Cumberland | |
| 6,415,584 | B1 | 7/2002 | Whhittall et al. | |
| 6,437,226 | B2 | 8/2002 | Oudshoorn et al. | |
| 6,784,353 | B1 | 8/2004 | Davis | |
| 6,806,411 | B1 | 10/2004 | Allen | |
| 7,109,405 | B2 | 9/2006 | Brown | |
| 7,285,710 | B1 | 10/2007 | Wallace | |
| 7,304,226 | B2 * | 12/2007 | Harris | 84/304 |
| 7,309,824 | B2 | 12/2007 | LeBlanc | |
| 7,329,808 | B2 | 2/2008 | Davis | |
| 7,446,248 | B2 * | 11/2008 | Skinn et al. | 84/312 R |
| 7,534,950 | B2 * | 5/2009 | Lyles | 84/453 |
| 7,544,873 | B1 * | 6/2009 | Stets | 84/313 |
| 7,550,661 | B1 * | 6/2009 | Willis | 84/318 |
| 7,692,085 | B2 * | 4/2010 | Adams | 84/454 |
| 7,858,865 | B2 * | 12/2010 | D'Arco | 84/454 |
| 2001/0002570 | A1 | 6/2001 | McCabe | |
| 2001/0029828 | A1 | 10/2001 | Oudshoorn et al. | |
| 2003/0177894 | A1 | 9/2003 | Skinn | |
| 2004/0194609 | A1 | 10/2004 | Allen | |
| 2005/0132868 | A1 | 6/2005 | Allen | |
| 2007/0006712 | A1 | 1/2007 | Lyles | |
| 2007/0227334 | A1 | 10/2007 | Ward | |
| 2011/0094366 | A1 * | 4/2011 | D'Arco | 84/454 |

* cited by examiner

TUNING STABILIZER FOR STRINGED INSTRUMENT

RELATED APPLICATIONS

This Application is a divisional of U.S. application Ser. No. 12/250,672, filed Oct. 14, 2008 now U.S. Pat. No. 7,858,865.

BACKGROUND OF THE INVENTION

Many stringed instruments, and guitars in particular, require periodic tuning to remain playable. Due to the stresses on the strings and the tuning mechanisms imposed during the normal course of use of the instrument, constant tuning may be required, even during the course of a single performance. The need for constant tuning may disrupt the flow of a performance and is a distraction for the musician.

Automatic tuners for guitars are well known in the art. Most are built into a guitar or require major modification to retrofit into a guitar and consist of a sensor for sensing the pitch of a string and a means for tensioning the string to achieve the proper tension.

Such a system is described in U.S. Pat. No. 6,437,226, issued Aug. 20, 2002 to Oudshoorn, et al. The patent describes system wherein a signal is induced onto a string under tension by a linear displacement motor. The resonance signal generated by the string is picked up by a transducer, converted to a digital signal and analyzed by a microprocessor. The motors then tension or slacken the string in response to the analysis to achieve the proper tuning.

Another such system is sold by Tronical, GmbH of Hamburg, Germany. The Tronical system requires that the musician strum the strings of the instrument to generate a test frequency, which is then analyzed by a microprocessor. The strings are tensioned or slackened by machine heads which are driven by servo motors.

Both the Oudshoorn system and the Tronical system are capable of tuning a guitar, regardless of how far out of tune. Such systems, however, not only are expensive, but have the drawback of requiring permanent installation in a guitar. Therefore, it would be desirable to have a device for keeping a stringed instrument in tune that could be used with any instrument, without the requirement of major modification to the guitar for permanent installation.

SUMMARY OF THE INVENTION

The present invention is a retro-fit device that may be used with any stringed instrument having a neck, such as a guitar, banjo, bass or violin. The device is not meant to perform the function of tuning the instrument from scratch, but instead is designed to maintain the instrument in tune after it has been hand-tuned, such as during the course of a performance.

The device consists of a mechanical portion that is attached to the neck of the instrument, much like a capo. The device has built-in sensors to pick up the frequency of a string and a microprocessor to determine when the strings have drifted from their tuned frequencies. The strings may then be "micro-tuned" by a series of cams which may be rotated to further tension or slacken each of the strings.

The device is completely self-contained and battery-powered, and has the advantages over the prior art systems of relatively low cost and portability. The device may quickly be attached and removed from the neck of the instrument.

DESCRIPTION OF THE DRAWINGS

FIG. 1(*b*) is a side view of a guitar having the device attached thereto.

FIG. 4(*b*) shows a side view of a sub-assembly of the device.

DETAILED DESCRIPTION

The invention herein described may be used with any stringed instrument having a neck defining a fretboard. The example used to show the embodiments of the invention utilize a guitar for explanation purposes only. This is not meant to limit the invention in any way. In addition, the device is meant to be compatible with guitars of all configurations, including 6 and 12 string varieties, as well as those guitars having all machine heads on one side of the headstock or divided between both sides of the headstock.

The device is preferably attached to the guitar like a capo, via a hinged clasp mechanism secured by a latch. The bottom brace of the clasp engages the rear of the headstock 52 or fretboard 50 of the guitar opposite the strings, while the top brace consists of the main body of the device. Preferably, the bottom brace is lined with a scratch-resistant material, such as rubber, neoprene or felt to prevent scratching the guitar, while still providing enough gripping power to keep the device securely fastened in place.

Figure 1A:
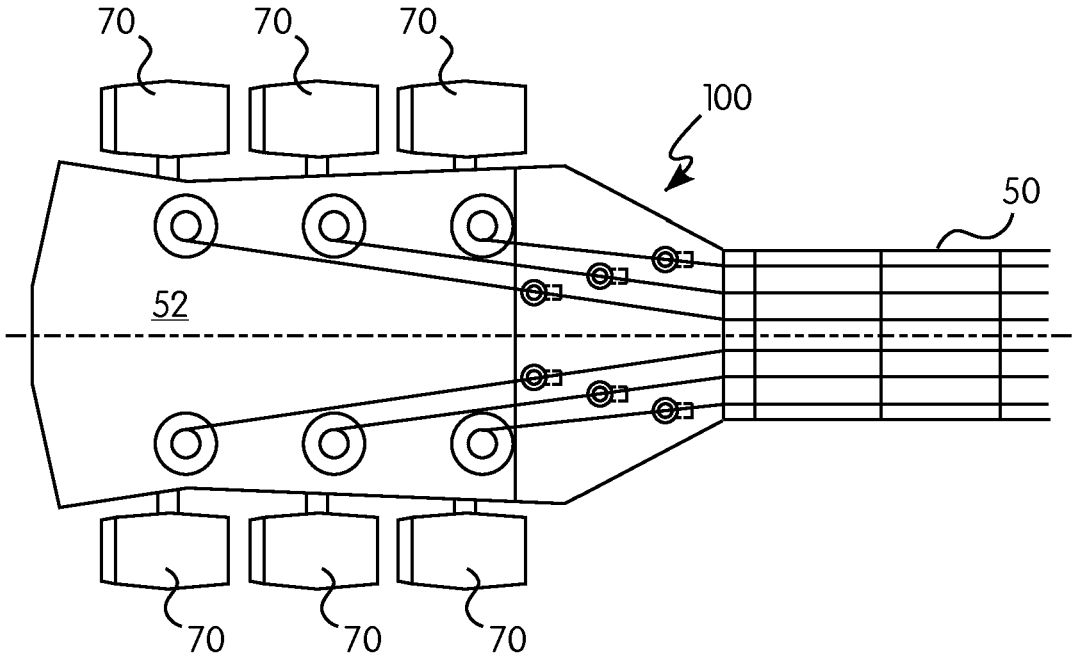
FIG. 1(*a*) is a top view of a guitar having the device attached thereto.
Figure 1B:
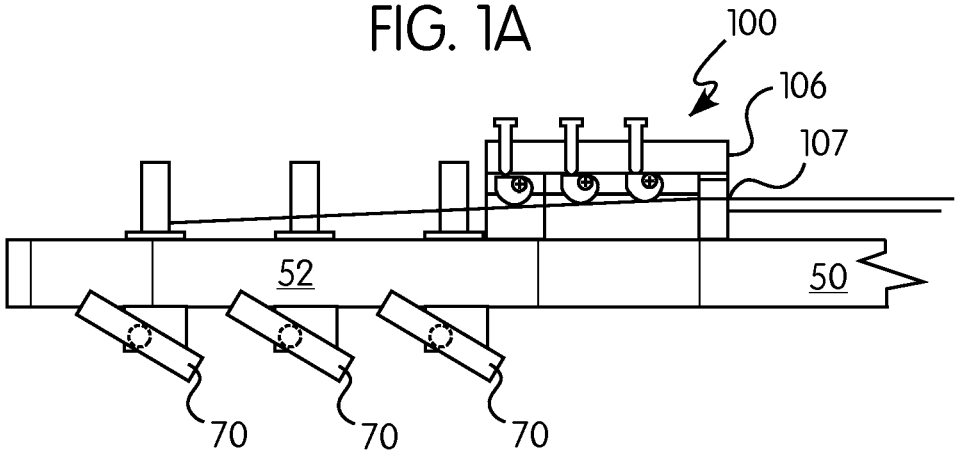

FIGS. 1(*a*) and 1(*b*) show top and side views respectively of the tuning device 100 mounted on a guitar in the preferred position. Tuning device 100 preferably sits between nut 107 and the first machine head 70 on headstock 52 of the guitar, with felt pad 106 resting on nut 107.

Figure 4A:
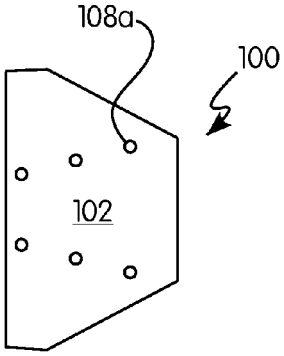
FIG. 4(*a*) shows a to view of a sub-assembly of the device
Figure 4B:
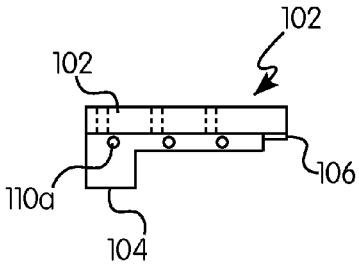

The body of tuning device 100 consists of a subassembly, shown in FIG. 4, which consists of top portion 102, heel portion 104 and felt pad 106. Defined in top portion 102 are a plurality of peg holes 108*a* through which pegs 108 are disposed. Heel 104 has defined therein a plurality of cam holes 110*a* which are the mounting points for cams 110. The subassembly of tuning device 100 can be composed of any material suited for the purpose, such as wood or plastic, as can cams 110 and pins or pistons 108. The invention is not meant to be limited to any particular material.

Figure 2:
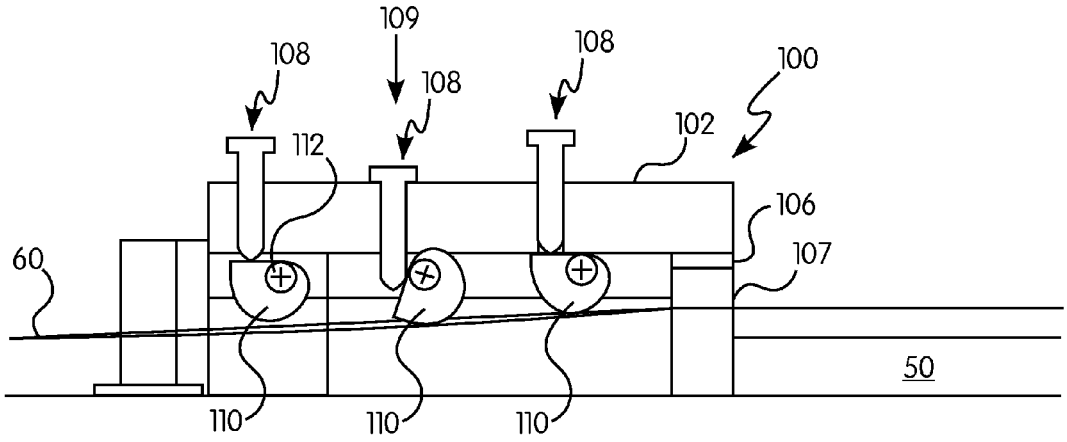
FIG. 2 shows a side view of a first embodiment of the invention mounted on a guitar.

With reference now to FIG. 2, showing a preferred embodiment of the invention, pegs 108 are disposed through peg holes 108*a* and are positioned one each in close proximity to each string 60 of the guitar. In the preferred embodiment of the invention, pegs 108 will rotate cams 110 which are mounted via connectors 112 through cam holes 110*a* by exerting a force on the lobe of cam 110. Cams 110 are positioned such that pressure in direction 109 as shown in FIG. 2 will cause pin 108 to rotate cam 110 to deflect against string 60, thus providing additional tension on string 60. Likewise, when pin 108 is moved in a direction opposite direction 109 cam 110 will be allowed to rotate in such as manner as to lessen the tension on string 60. Cams 110 may be rotationally driven by springs (not shown) which will drive them in a rotational direction to insure that they are always providing a resistive force against pin 108, such that the cams will return to their neutral position when the force exerted by pin 108 is lessened. It should be noted that cam holes 110*a* are not horizontally aligned but extend in a sloped direction dependant upon the slope and contour of headstock 52 of the guitar.

Cams 110 may be driven by a driving device (not shown), such as a motor, a solenoid, or a servo, that may generate a mechanical, electromechanical, pneumatic or hydraulic force upon the pins to drive them in direction 109. Any means of performing this function well known in the art may be used for this purpose.

In an alternate embodiment of the invention, cams 110 may be eliminated and pins 108 may be caused to press directly upon strings 60 of the guitar. In such a case, pins 108 may be spring loaded such as to be forced in the direction opposite direction 109.

Figure 3:
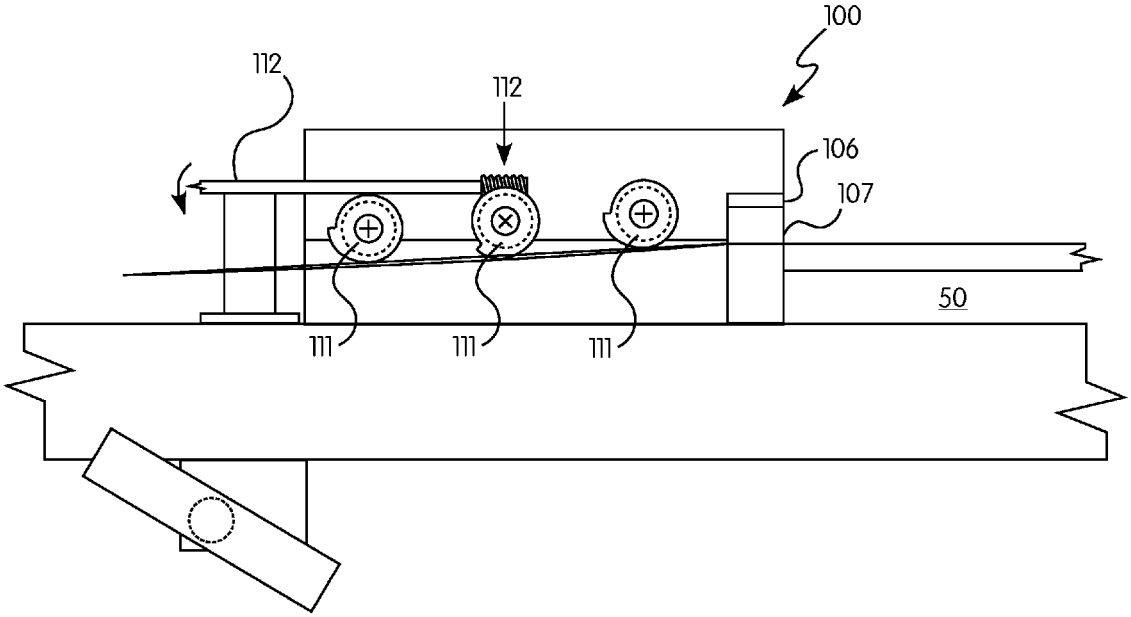
FIG. 3 shows a side view of a second embodiment of the invention mounted on a guitar.

FIG. 3 shows a second embodiment of the invention utilizing a different type of cam 111. Cams 111 are center mounted in cam holes 110*a* and define a worm gear on the outer edge thereof such as to be driven by a worm 113 defined on the end of shaft 112. A driver or servo to rotate shaft 112 (not shown) is also provided and may be of any standard means of providing a rotational force well known in the art. Note that in this embodiment of the invention, cams 111 need not be spring loaded, however the driver that rotates shaft 112 needs to be capable of providing a rotational force in both directions, such that cams 111 may also be rotated in both directions.

With respect to both embodiments shown in FIGS. 2 and 3, the rotating cam will preferably be able to provide at least a 0.04 inch deflection of each string 60 on the guitar.

Figure 5:
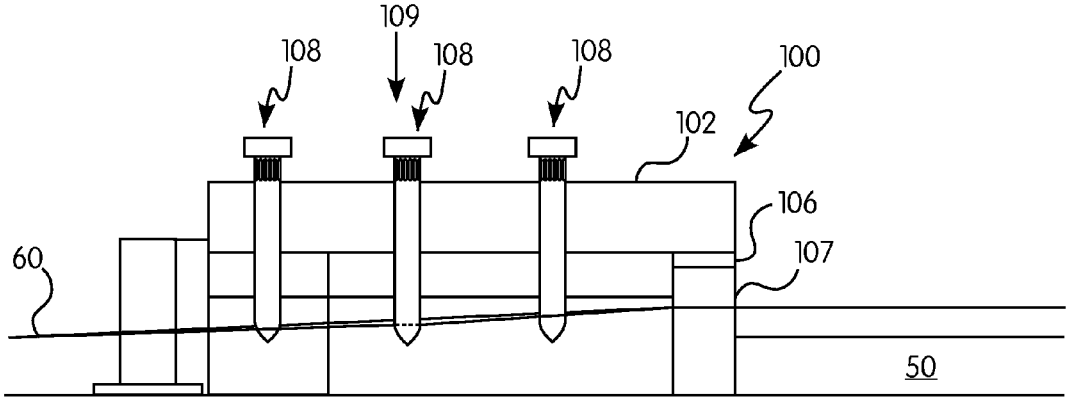
FIG. 5 shows a side view of a third embodiment of the device mounted on a guitar.
Figure 6:
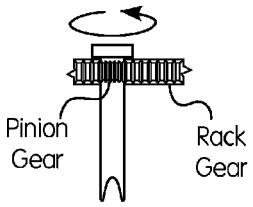
FIG. 6 shows the detail of the pin and gear assembly of the third embodiment.
Figure 7:
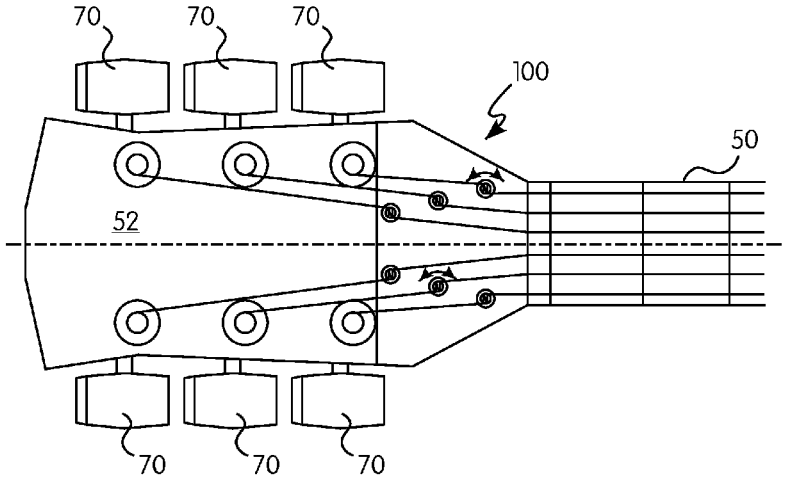
FIG. 7 shows the pin/string interaction of the third embodiment

A third embodiment of the invention is shown in FIGS. 5-7. In this embodiment, as shown in FIG. 5, pins 108 define notch 107 at the bottom end thereof, with notch 107 of each pin engaging one of strings 60. Pins 108 may then be rotated clockwise or counterclockwise to increase or lessen the tension on string 60.

Preferably, as shown in FIG. 6, pins 108 will define a pinion gear 105*b* around the outer circumference thereof. Pin 108 may then be rotationally driven by engagement with rack 105*a* or a circular gear (not shown). As with the first two embodiments of the invention, the linear motion of rack 105*a* may be driven by any means known in the art, such as by a geared motor, a solenoid, or a servo, that may generate a mechanical, electromechanical, pneumatic or hydraulic force on rack 105*a*.

FIG. 7 shows the engagement of pin 108 with string 60. Preferably, the inner contours of notch 107 will be rounded to reduce the possibility of breaking string 60.

In an alternate to embodiment 3, strings 60 could be wound multiple times around pins 108, such as to eliminate the need for machine heads 70. In some cases, entire headstock 52 could be eliminated. In this embodiment, pins 108 may take on a concave outer profile, such as to provide room for multiple windings of string 60 around pin 108. In addition, pins 108 may define a hole therein to accept the end of string 60. In this alternate embodiment, the guitar could become a completely self-tuning instrument, being able to tune to different pre-programmed ranges.

Also included as part of the invention, but not shown in the drawings, is a means of detecting the frequency of strings 60 as they are strummed by the musician. This means will likely consist of a plurality of audio input transducers which will pick up an analog signal from each of the strings. The analog signal would likely be converted to a digital signal via an analog to digital converter and then analyzed by either a programmed microprocessor or a specialized circuit capable of analyzing the received audio input and determining if the string needs to be retensioned to bring it back into tune.

In another aspect of the invention, the device cold be outfitted with a wireless transceiver such that a signal picked up by sensors from one or more of the strings could be sent wirelessly to a base station for amplification or processing, or may be supplied to a computer as a MIDI signal.

In operation, tuning device 100 would be initialized by zeroing the cams, such that the cams are deflected half way against the strings, or, as in the third embodiment, partially twisted around each of the pins. The guitar is then manually tuned utilizing machine heads 70 for each string in the normal manner. After a period of use, the guitar may have drifted out of tune. To have tuning device 100 perform the micro tuning adjustments to the strings to bring the instrument back into tune, the strings may be strummed either one at a time or in series while alerting tuning device 100 that a tuning operation has begun by, for example, depressing a button on the device.

It is also contemplated that tuning device 100 may assist the musician in the manual tuning of the guitar by providing an indication that each of the strings is sharp, flat or tuned to the correct frequency by providing some form of feedback to the musician, such as a light or series of lights which indicate if the string is sharp, flat or properly tuned.

Although the invention is shown having pins pushing against the cams to rotate them, it is contemplated that other means of rotating the cams could be used such as a direct drive of the cams with a servo providing a rotational force or a force exerted through a series of gears such as to provide rotational movement in both directions of the cams, thus allowing the pins to be eliminated. In addition, it is possible that the driver or servo mechanism could sit higher on the headstock than the rest of the device, such as between the machine heads, and be connected to the cams via a linkage.

The device is contemplated to be battery powered, with the batteries likely resident in the bottom brace of the device. It is also contemplated that the frequency detection circuitry and mechanical driver portions be located within the top portion 102 of the device, but in certain configurations, could also be located in the bottom brace, and thus be resident on the underside of fretboard 52 of the guitar and be linked via mechanical linkage to the cams.

I claim:

1. A tuning stabilizing device for a stringed instrument comprising:

a body portion adapted to be attached to a stringed instrument;

a plurality of mechanical members disposed within said body portion, said mechanical members having a one to one correspondence with the plurality of strings on said instrument, each of said mechanical members being situated to exert a rotational mechanical force on its corresponding string; and one or more linear drive mechanisms, for imparting a force to said plurality of mechanical members to cause them to exert said mechanical force on their corresponding strings;

wherein said mechanical members and said one or more drive mechanisms are coupled with a rack and pinion gear system.

2. The device of claim 1 further comprising a plurality of sensors, having a one to one correspondence with said plurality of strings on said instrument, each of said sensors being situated such as to sense the frequency at which its corresponding string is vibrating when said string is strummed by a user of the instrument.

3. The device of claim 2 further comprising an analyzer for using said sensed frequency is to determine is said string is sharp, flat, or properly tuned.

4. The device of claim 3 further comprising a linkage between said analyzer and said one or more driver mechanisms such that the pressure exerted by said one or more mechanical members on its corresponding string can be increased or decreased to bring said string into tune.

5. The device of claim 4 wherein said analyzer comprises:

an audio transducer;

an analog to digital converter linked to said audio transducer, for converting said sensed audio into a digital signal; and a programmed microprocessor or a specialized circuit capable of analyzing said digital signal to determine if said string producing said signal is sharp, flat or properly tuned.

6. The device of claim 1 wherein said mechanical members are pins defining a notch in one end thereof, each of said notched pins engaging a corresponding string, such as to increase or release the tension on said string when said pin is rotated.

7. The device of claim 1 wherein said drive mechanisms are able to impart a linear motion to said rack.

8. The device of claim 6 wherein each of said notches defines rounded interior walls.

9. The device of claim 1 wherein said mechanical members are pins around which a corresponding string may be wound such as to increase or release the tension on said string when said pin is rotated.

10. The device of claim 9 wherein each of said pins defines a pinion gear on the circumference thereof, and further wherein said pins are rotationally driven by a corresponding rack.

11. The device of claim 10 wherein said drive mechanisms are able to impart a linear motion to said rack.

12. The device of claim 9 wherein each of said pins defines a concave portion of the outer profile parallel to the longitudinal axis.

13. The device of claim 9 wherein each of said pins defined a hole therein through which the end of said corresponding string is threaded.

14. A tuning stabilizing device for a stringed instrument comprising:

a body portion adapted to be detachably mounted to a stringed instrument;

a plurality of mechanical members attached to said body portion, said mechanical members having a one to one correspondence with the plurality of strings on said instrument, each of said mechanical members being situated to exert a rotational mechanical force on its corresponding string;

one or more linear drive mechanisms, coupled to said plurality of mechanical members via a rack and pinion gear system, for imparting a force to said plurality of mechanical members to cause them to exert said mechanical force on their corresponding strings;

a plurality of sensors mounted on said body portion, said sensors having a one to one correspondence with the plurality of strings on said instrument, each of said sensors being capable of sensing the frequency of the audio signal produced by its corresponding string;

an analysis means, for determining if each of said strings is sharp, flat or properly tuned based on the sensed frequency; and a feedback loop wherein the output of said analysis means controls said drive mechanisms to increased or decrease the force exerted on each of said strings by said mechanical members, until each of said strings is tuned properly.

15. The device of claim 14 wherein said analysis means comprises:

an audio transducer for each of said strings;

an analog to digital converter linked to said audio transducers, for converting said sensed audio into a digital signal; and a programmed microprocessor or a specialized circuit capable of analyzing said digital signal to determine is said string producing said signal is sharp, flat or properly tuned.

16. The device of claim 14 further comprising one or more visual indicators indicating if each of said strings is sharp, flat, or property tuned.

17. The device of claim 15 further comprising a wireless transmitter in communication with a base station, for sending a wireless signal to said base station representing the outputs of said audio transducers.

* * * * *